US008127832B1

(12) United States Patent
Bond

(10) Patent No.: US 8,127,832 B1
(45) Date of Patent: Mar. 6, 2012

(54) WELL STIMULATION USING REACTION AGENTS OUTSIDE THE CASING

(76) Inventor: Lesley O. Bond, Neosho, MO (US)

( * ) Notice: Subject to any disclaimer, the term of this patent is extended or adjusted under 35 U.S.C. 154(b) by 0 days.

(21) Appl. No.: 12/888,726

(22) Filed: Sep. 23, 2010

Related U.S. Application Data

(63) Continuation of application No. 11/856,830, filed on Sep. 18, 2007, now abandoned.

(60) Provisional application No. 60/826,355, filed on Sep. 20, 2006.

(51) Int. Cl.
*E21B 29/02* (2006.01)

(52) U.S. Cl. ..... 166/63; 166/297; 166/299

(58) Field of Classification Search ..... 166/297, 166/299, 63, 262
See application file for complete search history.

(56) References Cited

U.S. PATENT DOCUMENTS

| | | | | | |
|---|---|---|---|---|---|
| 2,177,601 | A * | 10/1939 | Smith | 166/142 |
| 2,831,429 | A * | 4/1958 | Moore | 102/307 |
| 2,931,437 | A * | 4/1960 | Smith | 166/262 |
| 2,935,020 | A * | 5/1960 | Howard et al. | 102/307 |
| 3,072,190 | A * | 1/1963 | Reichle | 166/262 |
| 4,064,935 | A * | 12/1977 | Mohaupt | 166/63 |
| 4,160,412 | A * | 7/1979 | Snyer et al. | 102/307 |
| RE30,711 | E * | 8/1981 | Suman, Jr. | 166/285 |
| 4,391,337 | A * | 7/1983 | Ford et al. | 175/4.6 |
| 4,683,943 | A * | 8/1987 | Hill et al. | 166/63 |
| 5,355,802 | A * | 10/1994 | Petitjean | 102/313 |
| 6,009,947 | A * | 1/2000 | Wilson et al. | 166/299 |
| 6,082,450 | A * | 7/2000 | Snider et al. | 166/55.2 |
| 6,386,288 | B1 * | 5/2002 | Snider et al. | 166/298 |
| 6,536,524 | B1 * | 3/2003 | Snider | 166/297 |
| 6,557,636 | B2 * | 5/2003 | Cernocky et al. | 166/297 |
| 6,755,249 | B2 * | 6/2004 | Robison et al. | 166/262 |
| 6,817,298 | B1 * | 11/2004 | Zharkov et al. | 102/312 |
| 6,991,044 | B2 * | 1/2006 | Zhang et al. | 175/4.6 |
| 7,152,676 | B2 * | 12/2006 | Vella et al. | 166/250.14 |
| 7,165,614 | B1 * | 1/2007 | Bond | 166/297 |
| 7,216,708 | B1 * | 5/2007 | Bond et al. | 166/297 |
| 7,273,102 | B2 * | 9/2007 | Sheffield | 166/297 |
| 7,431,083 | B2 * | 10/2008 | Olsen | 166/259 |
| 7,621,332 | B2 * | 11/2009 | Haney et al. | 166/298 |
| 2002/0125011 | A1 * | 9/2002 | Snider et al. | 166/297 |
| 2003/0037692 | A1 * | 2/2003 | Liu | 102/301 |
| 2003/0164037 | A1 * | 9/2003 | Moffatt et al. | 73/152.46 |
| 2004/0206503 | A1 * | 10/2004 | Bell et al. | 166/297 |
| 2004/0231840 | A1 * | 11/2004 | Ratanasirigulchai et al. | 166/259 |
| 2008/0073081 | A1 * | 3/2008 | Frazier et al. | 166/280.1 |

* cited by examiner

*Primary Examiner* — David Bagnell
*Assistant Examiner* — Blake Michener
(74) *Attorney, Agent, or Firm* — Mary M. Lee

(57) ABSTRACT

Methods and apparatus for stimulating oil or gas wells using material cemented outside the casing. Reaction agents, usually comprising oxygen-rich material and a coil of high order explosive, are positioned around the outside of the well casing at a desired level in a carrier and reacted later. The stimulation operation is initiated by firing a shaped charge into the high order explosive material. The combination of the explosive force of the high order explosive and burning of the oxygen-rich material fractures and cleans the formation adjacent to the well casing. The reaction agents may be provided in a sleeve supported on the casing joint at the time it is inserted into the well. In another embodiment, all components would be cemented externally to the casing and reacted remotely by a coded signal.

20 Claims, 7 Drawing Sheets

WELL STIMULATION USING REACTION AGENTS OUTSIDE THE CASING

CROSS-REFERENCE TO RELATED APPLICATION(S)

The application is a continuation of U.S. patent application Ser. No. 11/856,830, filed Sep. 18, 2007, entitled "Well Stimulation Using Reaction Agents Outside the Well Casing," presently pending, which application claims the benefit of the filing date of provisional application No. 60/826,355, filed Sep. 20, 2006, entitled "Well Stimulation Using Shaped Charges to Ignite Oxygen-Rich Material Around the Well Casing," now expired. The contents of both these prior applications are incorporated herein by reference.

FIELD OF THE INVENTION

The present invention relates to methods and devices for stimulating oil and gas wells to increase production.

BACKGROUND OF THE INVENTION

The quantity of oil and gas production from a hydrocarbon bearing stratum into a borehole is influenced by many physical factors. Darcey's flow equation, which defines flow in a well, takes into account the reservoir constants of temperature, viscosity, permeability, reservoir pressure, pressure in the borehole, thickness of the producing strata, and the area exposed to flow.

It has long been known that increasing the exposed flow area in a producing well increases production. For example, it is known that drilling a larger diameter hole exposes more of the producing strata and thus increases production.

Enlarging the flow areas, in open hole intervals, has been accomplished by using both explosives and chemicals. However, use of these agents is somewhat limited where the producing strata are cemented behind steel casing. In cased applications, the well is "perforated" to create small holes that extend through the steel casing, the annulus cement and the adjacent formation.

Prior to the invention of the shaped charge, wells were perforated with multiple, short-barreled guns. The bullets penetrated the casing, the annulus cement, and the producing strata. The shaped charge, with its greater penetration and reliability, though, has largely replaced the so-called "bullet guns."

Conventional shaped charges make holes through the casing and into the strata by forming a high speed stream of particles that are concentrated in a small diameter jet. As the high energy particles hit solid material, the solid material is pulverized. Thus, shaped charges can be used to place numerous small perforations where desired in a well. However, the fine material from the pulverized rock and the shaped charge particles can have a detrimental effect on fluid flow in the area around the perforation. Debris from the spent charge as well as fragments and particles from the pulverized formation tend to plug the perforations and obstruct passages in the fractured formation.

The formation pressure acts on the small oil droplets in the formation to force the hydrocarbons from the connected pore spaces into the well bore. The magnitude of the area in the formation exposed by the perforations directly affects the amount of flow and/or work required for that production. Accordingly, increasing the exposed flow area by perforation does two favorable things: it increases the flow rate directly, and it reduces the amount of work required to maintain a given production rate. Increasing the flow area in a well increases the ultimate recovery from the well/reservoir by conserving formation pressure or reservoir energy.

DETAILED DESCRIPTION OF THE PREFERRED EMBODIMENT(S)

Figure 1:
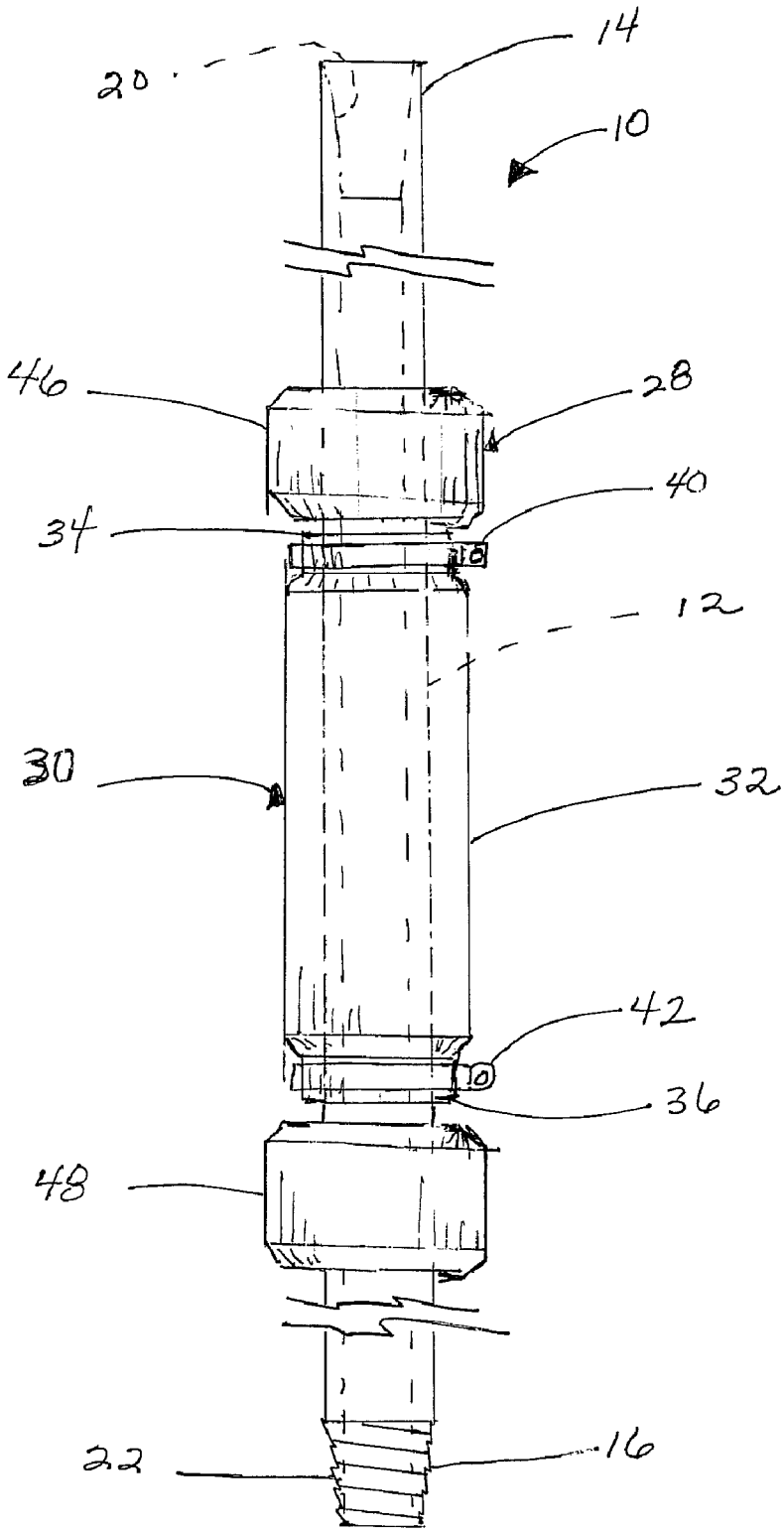
FIG. 1 is an elevational, fragmented view of a joint of well casing augmented in accordance with the present invention to include a sleeve containing oxygen-rich material and upper and lower bumpers to protect the sleeve.

The present invention provides methods and devices capable of increasing the exposed surface area in the producing strata by creating fractures and flow channels to increase production. In accordance with the present invention, one or more bodies of oxygen-rich material, preferably augmented with high order explosives, are placed in a container and attached to the outside of a well casing. A protective cover may be used to protect the container as the casing is cemented in the well bore. The well's producing strata then can be stimulated by firing a shaped charge to initiate the explosive and burning reactions of the material.

The oxygen-rich material produces oxygen gas that reacts with the hydrocarbons in the producing strata to burn in the pyrotechnic environment. The oxygen-rich material may be a nitrate, such as potassium nitrate, or it may be other oxygen compounds such as a perchlorate.

The high order explosive initiates and extends fractures in the strata. The high order explosive material preferably has a fast detonation velocity with a maximum ratio of shock to gas force generation. The explosive material preferably is RDX formed into a cord or rope shape. The explosive material may be contained inside a carrier tube similar to a detonation cord. Using RDX produces a high order explosive with a detonation velocity of about 28,800 feet per second ("fps"). Alternately, for larger diameters, the explosive material could be a commercially available detonation cord.

When in the form of a cord or rope, the explosive material may be positioned in a helix within the body of oxygen-rich material. The coiled explosive reacts rapidly relative to the slow-burning oxygen-rich material. Alternately, the explosive material could be in the form of a solid sheet thicker than critical for activation. In most instances, it is desirable to place the high order explosive a distance away from the well casing so as to minimize damage to the casing. A protective shield could be utilized between the explosive and the casing to further minimize casing damage. Additionally, the section of casing carrying the reactive materials could be thicker or reinforced.

Although the form and configuration of the explosive material may vary, it should be evenly distributed around the casing to minimize the degree of damage to the casing so as to maintain the integrity of the casing while still perforating it effectively.

The vaporization of the oxygen-rich material around the casing, and its reaction with the hydrocarbons in the formation, is a relatively slow, prolonged reaction, probably in the magnitude of 1,000 fps. More than about ninety percent (90%) of this reaction takes place after the high order explosive reaction has concluded. This combination of reactions provides a maximum benefit from the slower, oxygen-carbon reaction.

While the preferred embodiment of the present invention involves two reactions in combination, the present invention contemplates a combination of three or more explosive components, especially several explosive components with different detonation velocities to produce a staggered or pulsed performance. Additionally, different amounts of reagents may be used at different depths in the well, for independent stimulation operations.

The shaped charged used to initiate the reactions of the oxygen-rich material and the explosive may be conventional shaped charges from inside the well or inwardly directed shaped charges included inside the container of reaction agents. In the latter embodiment, the sleeve contains no shaped charges directed outwardly towards the formation and the reaction could be initiated remotely by a coded signal, such as an electromagnetic or acoustic signal. The ignitor then would react with the corded explosive to fire the internal shaped charge and start the reactions of the high order explosives and the oxygen-rich material. In this way, the shaped charge perforates the casing from the outside towards the inside of the casing while at the same time igniting the explosive coil and initiating the burn of the oxygen-rich material. A stimulation operation initiated in this manner minimizes the damage and contamination of the strata and allows for an underbalanced well completion ready for production. In formations comprising soft and unconsolidated sands, a sand filter or screen may be included in the reagent container to prevent sand from flowing back into the casing during post-stimulation production.

Depth control in the placement of the reagent container may be accomplished by depth and length measurements of the casing joints, or by casing collar location references, or by a combination of these techniques. Alternately, where depth control techniques are unreliable, short reference joints of casing could be employed, or the reagent container could be positioned by using magnetic or radioactive tags in or near the container.

In yet another application of the present invention, an extra-casing reagent container could be devised to shoot the casing string apart in order to abandon the well. Thus, the present invention has applications beyond well stimulation procedures. These and other features and applications of the present invention will be apparent from the following description of the preferred embodiments.

The delivery of an oxygen source to the hydrocarbon-containing formation, in the presence of the explosive reaction, provides sustained explosive burning of the hydrocarbons in the vicinity of the augmented well casing. The burning in the formation continues until the concentration of oxygen is reduced, at which point the burning self-extinguishes. Thus, the extent of the burning can be controlled to some extent by selecting the amount of oxygen-rich material provided in the container.

The significant secondary reaction in the strata has two beneficial effects. In the first place, the reaction will cause a cleaning effect on the fine particles that might otherwise plug the perforation. The cleaning effect occurs when the explosive burning causes high pressure gases to be generated, and these pressurized gases are discharged rapidly back into the borehole or casing. Secondly, the extended burning or explosion in the treated stratum causes further fracturing of the formation. This results in further expansion of the exposed flow areas in the formation beyond the initial shape charge perforation. In addition, in the event the strata being perforated are water bearing, the explosive reaction will not occur; rather, only oil or gas bearing formations will be stimulated.

With reference now to the drawings in general and to FIG. 1 in particularly, there is shown therein a joint of well casing constructed in accordance with a first preferred embodiment of the present invention and designated generally by the reference numeral 10. The casing joint 10 is adapted for use in a well stimulation operation in an oil and gas well.

The joint 10 is similar to conventional well casing in that it comprises a tubular body 12 with first and second ends 14 and 16. As the joint is used in connection with similar joints to form a string of casing, each end 14 and 16 is provided with a coupling or other means by which the end is connectable to the end of another joint. Typically, the coupling on one end 14 of the joint 10 is an internal threaded or box joint 20, and the other end 16 is an externally threaded or pin joint 22. The methods and materials for making casing joints are well known and therefore will not be described herein. As is also well known in the art, the dimensions of the joint 10 may vary.

Referring still to FIG. 1, the joint 10 preferably further comprises a well stimulation accessory designated generally at 28. The preferred accessory 28 includes at least one sleeve 30 supported on the body 12. The sleeve 30 is generally tubular in shape having an inner diameter slightly larger than the outer diameter of the joint 10 and is adapted to be supported at a selected position along the length of the joint 10. While the outer diameter of the sleeve 30 may vary, it will be narrower than the uncased wall of the well so as to be receivable therein.

The sleeve 30 may be a solid tube that slips over one end of the joint 10. Alternately, the sleeve 30 may have a longitudinal slit which can be spread open so that the joint 10 may be forced into the tube. Still further, the sleeve 30 may be formed in two or more segments that are placed around the joint. In the embodiment depicted in FIG. 1, the sleeve 30 is a solid tube comprising a central body portion 32 and first and second ends 34 and 36.

In most cases, it will be advantageous for the sleeve 30 to be adjustably or removably or both adjustably and removably supported on the joint 10. To that end, the first and second ends 34 and 36 may comprise connecting portions having narrower outer diameters as shown. This facilitates the use of first and second clamps 40 and 42, one on each of the ends 34 and 36, respectively. The clamps are tightened to ensure that the longitudinal position of the sleeve 30 on the joint 10 is secured.

In some cases permanent affixation of the sleeve 30 to the joint body 12 may be desired. In such cases, the sleeve could be adhered to the joint body 12 by any suitable technique, such as by molding it and then covering the sleeve with a protective sealant.

Now it will be appreciated that the sleeve 30 preferably will be formed of a durable and flexible material, such as rubber. Whichever material is selected, it should be relatively resistant to damage from impact as it is placed into the uncased well, and should impermeable to water and other fluids typically encountered down hole. In addition, the sleeve 30 should be formed so that an exploding shaped charge will pierce or disrupt the wall of the sleeve to release the material contained therein as will be explained further hereafter.

Although the sleeve 30 will be formed to be resistant to damage down hole, in most instances it will be desirable to include in the accessory 28 a pair of resilient protective bumpers 46 and 48. These bumpers 46 and 48, also usually formed of rubber, will be tubular and designed to be supported at a selected position along the length of the joint 10. For proper positioning of the joint 10 the bumpers 46 and 48 may also equipped with radioactive pips or, alternately, with a magnetic component.

Figure 2:
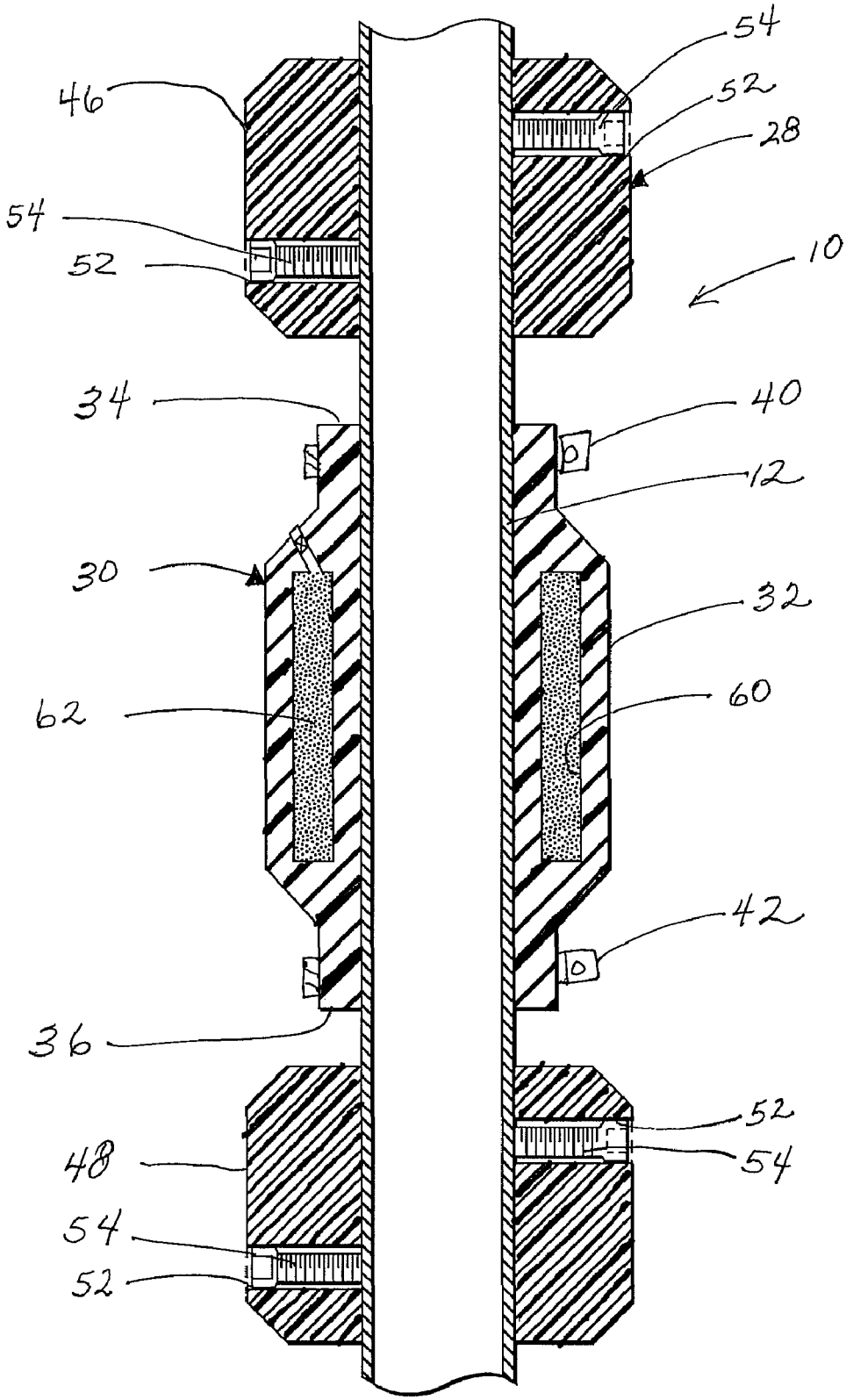
FIG. 2 is longitudinal sectional view of the segment of the casing shown in FIG. 1 showing the internal structure of the sleeve.

Turning now to FIG. 2, the structure of the well stimulation accessory 28, including the sleeve 30 and bumpers 46 and 48, will be described in more detail. As this cross-sectional view shows, the bumpers 46 and 48 preferably are formed of solid rubber material and have one or more internally threaded radial bores, all designated as 52, for threadedly receiving set screws, all designated as 54, for securing the selected position of the bumpers 46 and 48 on the joint 10.

The sleeve 30 defines at least one internal compartment 60 adapted to contain an oxygen-rich material 62. In the embodiment of FIGS. 1 and 2, the compartment 60 is a single continuous annular chamber. However, there may be multiple separate chambers disposed radially or axially.

Preferably, the oxygen-rich material 62 is potassium nitrate. However, the other materials such as ammonium nitrate may be utilized in addition to or instead of potassium nitrate. As used herein, "oxygen-rich material" denotes any material capable of releasing oxygen when activated.

Figures 3A, 3B, 3C:
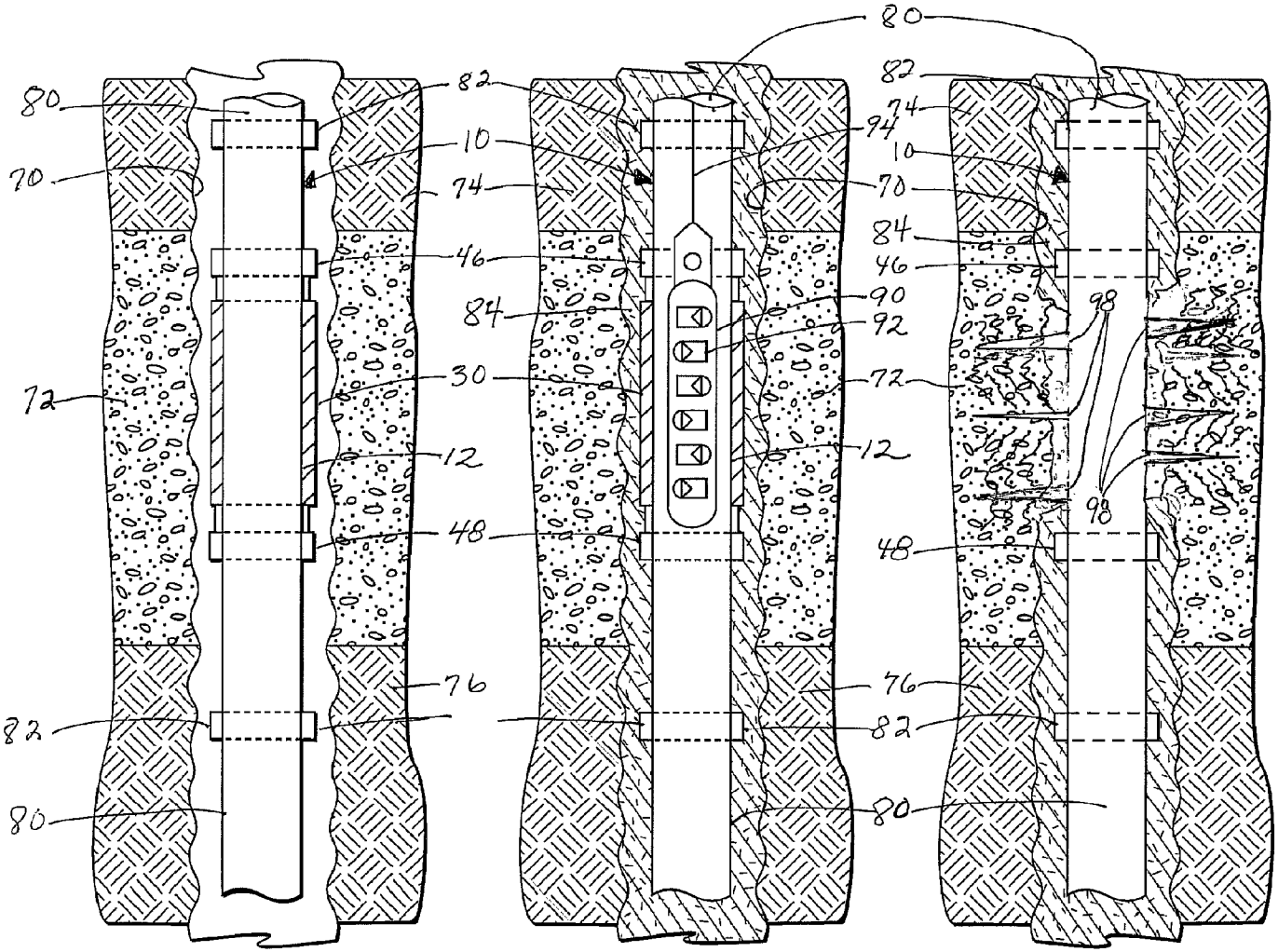
FIGS. 3A-3C are schematic illustrations of the use of the casing joint of FIGS. 1 and 2 and the well stimulation method of the present invention.

An illustrative well environment is shown in FIGS. 3A-3C, to which attention now is directed. These figures show a section of an oil or gas well 70 extending through a target stratum 72 between shale zones 74 and 76 above and below. As shown in FIG. 3A, the casing string 78 is positioned in the well 70 in a conventional manner. The casing string 78 will comprise at least one casing joint 10, with the sleeve 30 enclosing the body of oxygen-rich material 62 (FIG. 2), between conventional joints, all designated as 80, and joined thereto by casing collar connectors, all designated as 82.

The sleeve 30 on the joint 10 is positioned at the level of the target stratum 72. To facilitate correct placement of the sleeve, radioactive pips (not shown) could be included in the sleeve 30 or in the bumpers 46 and 40 or both. In this way, nuclear well logging records would enable the operator to verify the position of the sleeve 30. Alternately, magnetic markers could be employed. U.S. Pat. No. 5,279,366, entitled "Method for Wireline Operation Depth Control in Cased Wells," describes radioactive and magnetic based depth control procedures for oil and gas well, and the contents of this patent are incorporated herein by reference.

Next, as seen in FIG. 3B, cement 84 is injected into the annulus around the casing string 78. A container 90 enclosing a plurality of longitudinally spaced shaped charges 92 is then lowered into the well on a wire line 94 in a known manner, and the charges are detonated. It will be understood that the shaped charges 92 may be at different levels and usually will be directed radially so as to pierce the casing joint body 12 and the surrounding sleeve 30 in multiple directions and at several levels.

FIG. 3C shows the effect of the exploded charges 92 on the casing, the sleeve 30 and the surrounding formation. The sleeve 30 is substantially destroyed, leaving perforations 98 in the casing joint 12, the cement 84, and the target stratum 72 corresponding to the positions of the shaped charges 92. The sustained, explosive burn of the hydrocarbons in the formation surrounding the perforations 98 has substantially increased the surface area for production by fracturing and cleaning the formation.

Figures 4A, 4B, 4C:
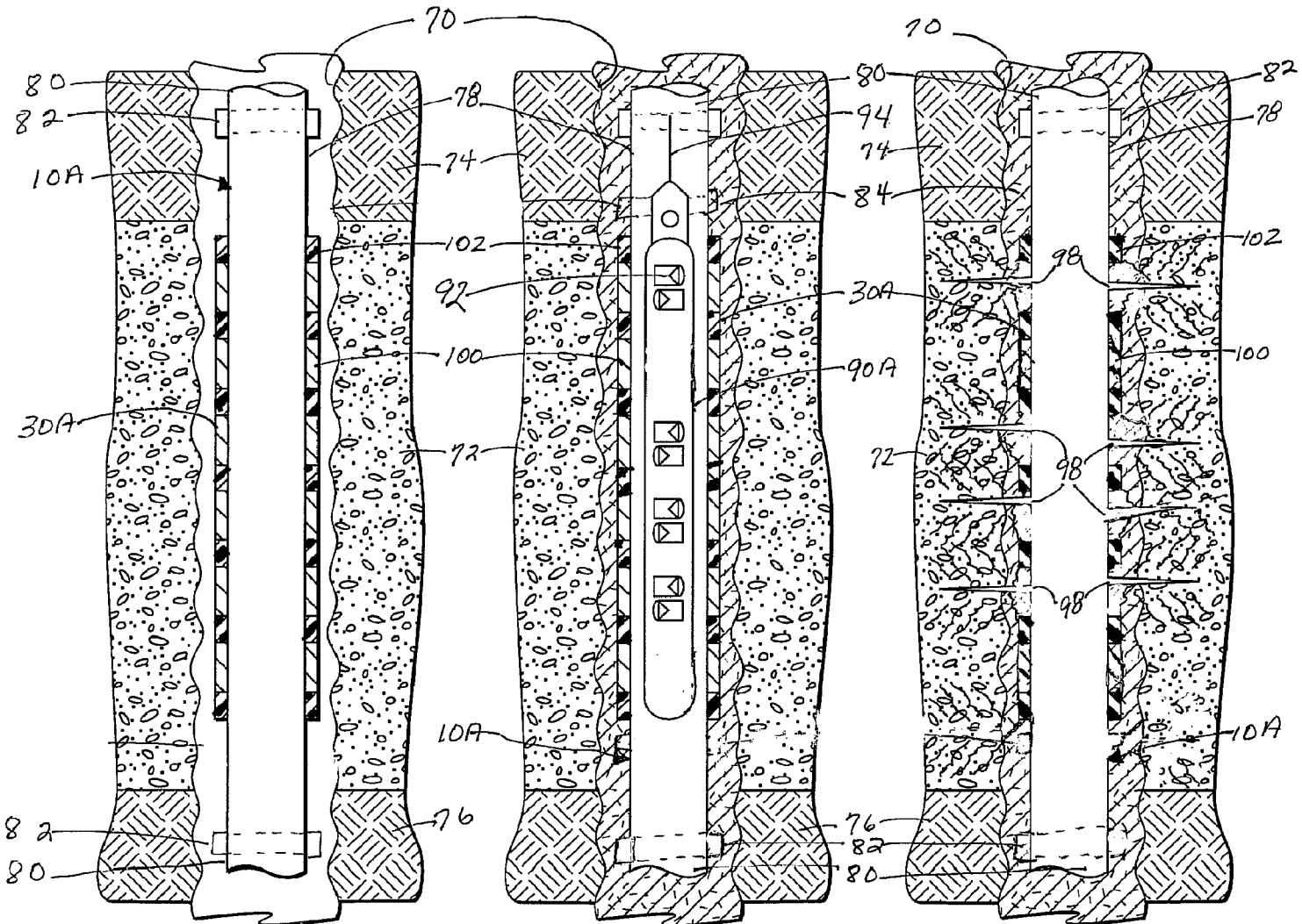
FIGS. 4A-4C are schematic illustrations of the use of an alternate embodiment of the casing joint and well stimulation method of the present invention.

Another embodiment of the inventive casing joint 10A comprising a modified well stimulation accessory 28A is illustrated schematically in a well environment in FIGS. 4A-4C, which will now be explained. The casing joint 10A extends down through the oil or gas well 70 and through a target stratum 72 between shale zones 74 and 76 above and below. As shown in FIG. 4A, the casing string 78 is positioned in the well 70.

The casing joint 10A is similar in construction to the joint 10 described previously, except that the sleeve 30A comprises multiple sections or bands, designated collectively at 100, with protective bumper blocks, designated collectively at 102, between each band and on each end. Each band 100 encloses a body of oxygen-rich material in a compartment (not shown in FIGS. 4A-4C) similar to the compartment 60 and material 62 in FIG. 2. Thus, the sleeve 30A comprises a plurality of longitudinally spaced annular chambers housing a plurality of bodies of oxygen-rich material.

In manner previously described, the sleeve 30A is positioned at the level of the target stratum 72. Next, as seen in FIG. 4B, cement 84 is injected into the annulus around the casing string 78. Then, the container 90A enclosing a plurality of longitudinally spaced shaped charges 92 is lowered into the well on a wire line 94. Now it will be seen that the multi-band embodiment of FIGS. 4A-4C permits the operator to selectively position the charges 92 to perforate some but not all of the bands 100 in the sleeve 30A. Then, as seen FIG. 4C, when the charges 92 are detonated, the stratum 72 is fractured only at the pre-selected positions 98.

As shown in FIG. 4C, the targeted bands of the sleeve 30A are destroyed, leaving perforations 98 in the casing joint 12, the cement 84, while the remaining bands are intact. The remaining bands 100 may be perforated at a later time, as further stimulation is required.

Figure 5:
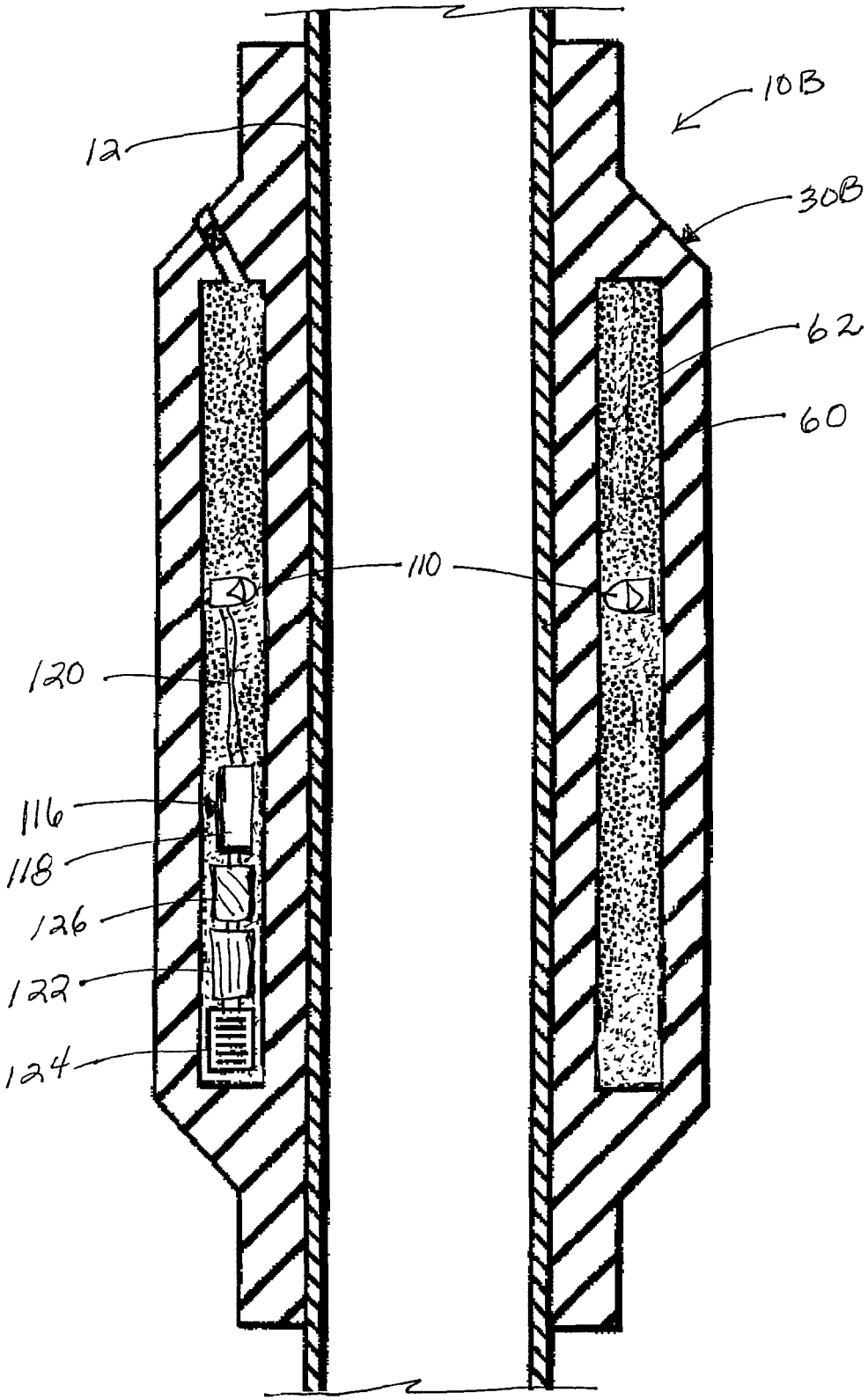
FIG. 5 is a longitudinal sectional view of another embodiment of the sleeve of the present invention comprising internal miniature shaped charges pointed inwardly towards the well and equipped with a remotely and wirelessly controlled detonator assembly.

With reference now to FIG. 5, a third embodiment of the inventive casing joint designated as 10B comprising a well stimulation accessory 28B will be described. In this embodiment, the sleeve 30B is shaped similarly to the sleeve 30 in FIG. 2 with a compartment 60 comprising a single annular chamber formed inside to contain a body of oxygen-rich material 62. This embodiment, however, eliminates the need for a separate shaped charge apparatus, such as the container 90 in FIGS. 3A-3C and 4A-4C. Instead, as depicted in FIG. 5, a plurality of miniature shaped charges 110 is included in the compartment 60.

The charges 110 are smaller than conventional shaped charges for typical perforation operations and, more specifically, are sized to fit within the compartment 60. Of course, the smaller size of the charges 110 means they each contain a smaller amount of explosive. However, in this embodiment, the charges need only perforate the inner wall of the sleeve 30C forming the compartment 60 and the adjacent casing wall. Therefore, even this smaller size can easily accommodate sufficient explosive force for this purpose.

In addition to perforating the casing, detonation of the inwardly directed charges 110 ignites the surrounding oxygen-rich material, which in turn bursts the sleeve compartment 60 and allows the burning material to spill into the surrounding stratum 72. This causes a limited burn of the hydrocarbons in the stratum 72 and leads to fracturing and improved production.

It will be apparent now that the wire line 94 (FIGS. 3A-3C & 4A-4C) is not available to detonate the charges. Instead, the sleeve 30B incorporates its own internal remote-controlled detonation assembly that is operatively connected to the charges 110.

Referring still to FIG. 5, a preferred detonation assembly 116 will be described. The charges 110 are connected to each other in series and to an explosive igniter 118, preferably but not necessarily electrical, by an explosive detonator or primer cord 120, typically a high order explosive. A signal receiver 122 powered by a battery 124 or other power source is connected to a coded safety relay circuit 126, which is connected to the igniter 118.

Sound propagation signals or electromagnetic field transmission signals emitted at the surface near the well head (not shown) are receivable by the receiver 122. In response to the signal, the receiver 122 communicates with the relay circuit 126 to activate the igniter 118, thereby detonating the charges 110. In this way, the detonation of the charges 110 is carried out wirelessly and remotely from above ground.

The shaped charges 110 and the detonation assembly 116 are shown embedded in the oxygen-rich material inside the single chamber or compartment 60. However, other arrangements may be employed. For example, the detonation assembly 116 could be housed in a separate compartment.

Figure 6:
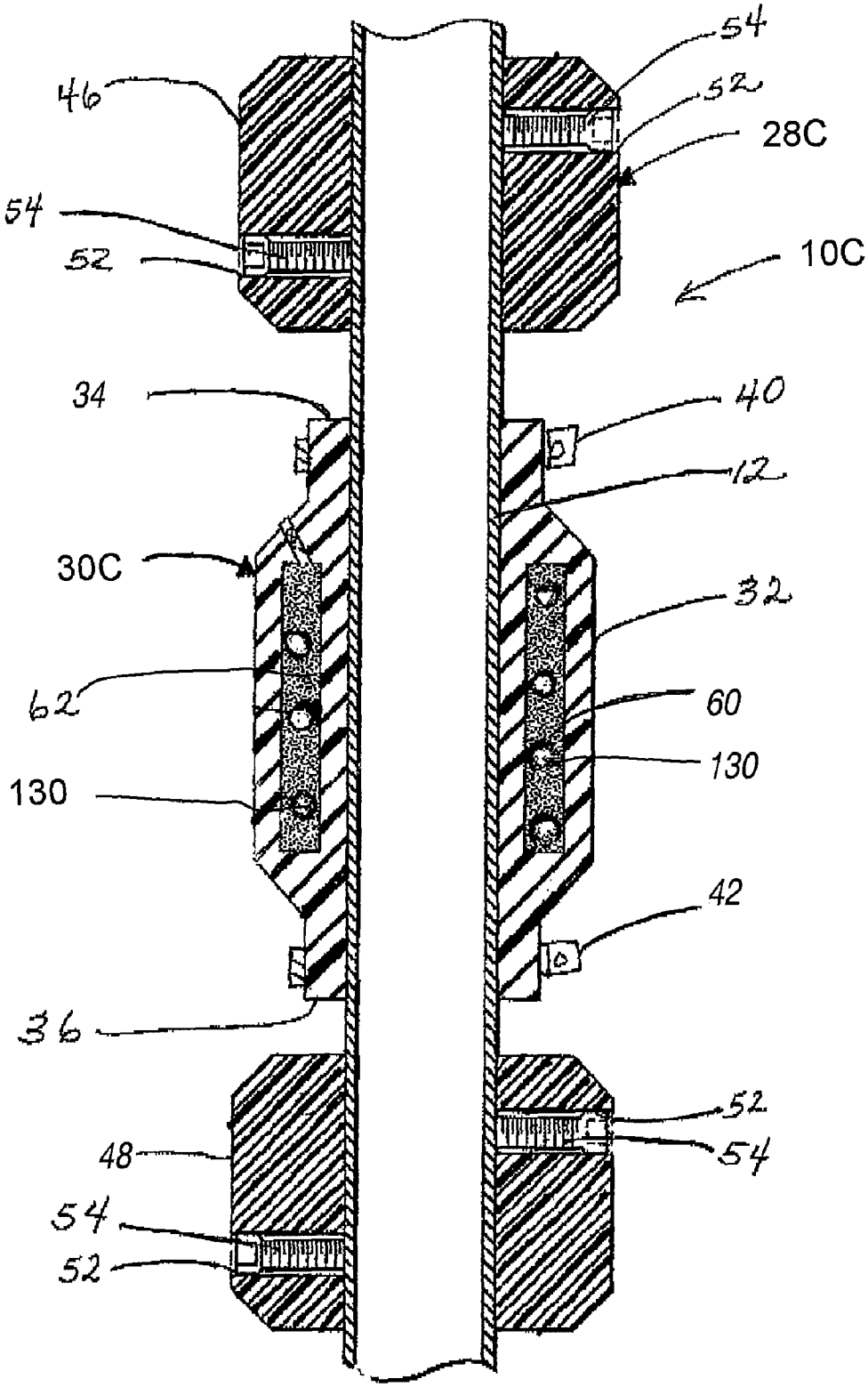
FIG. 6 is a longitudinal sectional view of still another embodiment of the present invention comprising the sleeve shown in FIG. 2 with a moderately high order explosive coil combined with the oxygen-rich material.
Figure 7:
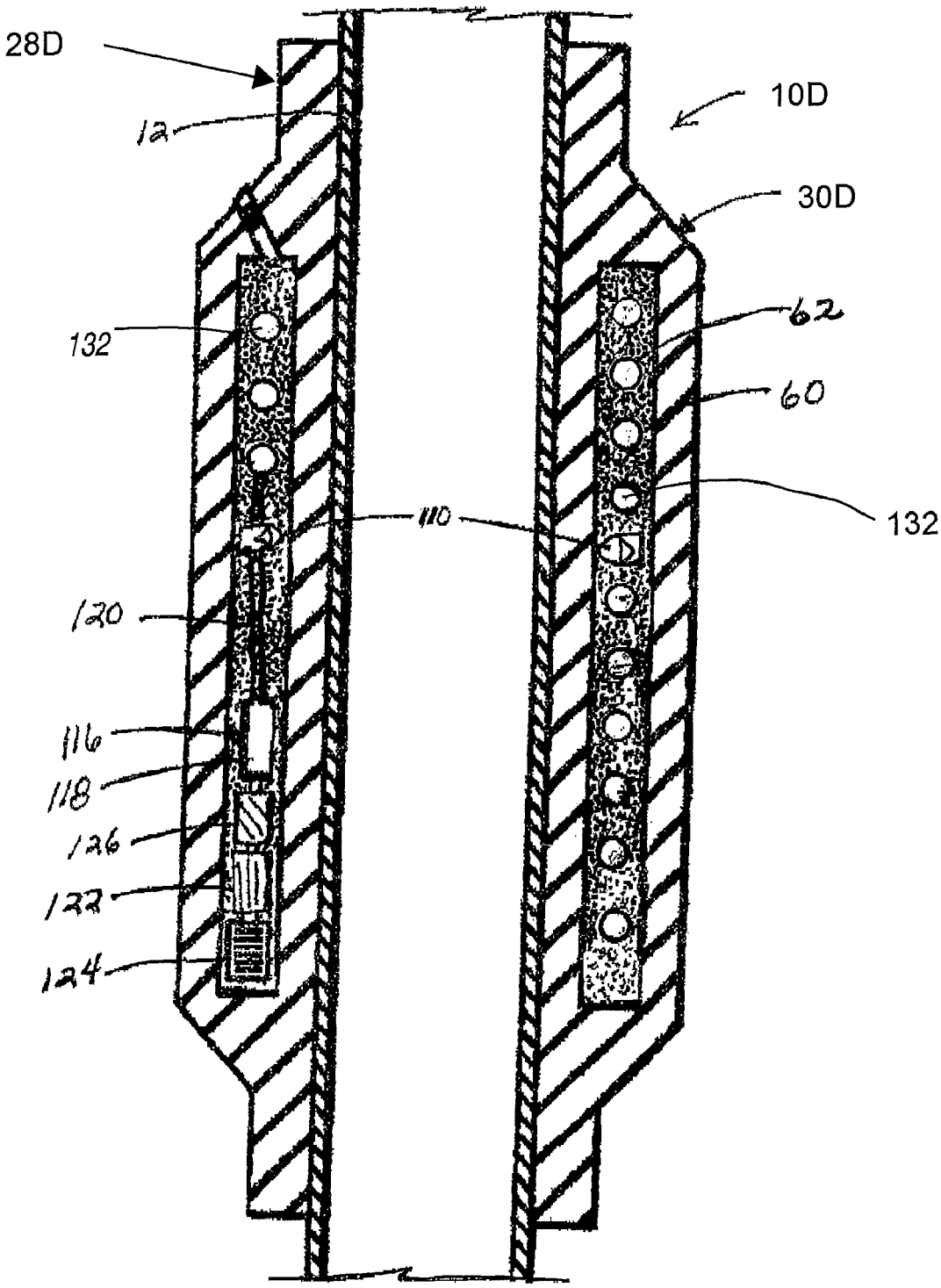
FIG. 7 is a longitudinal sectional view of still another embodiment of the present invention comprising the sleeve shown in FIG. 5 with a moderately high order explosive coil combined with the oxygen-rich material and other components inside the sleeve.

Turning now to FIGS. 6 and 7, the use of the explosive in combination with the oxygen-rich material is illustrated. In FIG. 6, the casing joint is designated as 10C, and the sleeve 30C is shaped similarly to the sleeve 30 in FIG. 2 with a compartment 60 comprising a single annular chamber formed inside to contain a body of oxygen-rich material 62. The explosive material 130 is provided in the compartment 60 in addition to the oxygen-rich material 62. In FIG. 7, the casing joint 12 is designated as 10D, and the sleeve 30D is shaped similarly to the sleeve 30B in FIG. 5. The explosive material 132 is provided in the compartment 60 in addition to the oxygen-rich material 62.

Preferably, the explosive material 130 and 132 is a high order explosive or a moderately high order explosive, that is, an explosive having a detonation velocity in the range of about 15,000 f/s to about 28,000 f/s. The explosive 130 and 132 serves to create and extend fractures and flow channels in the strata to move the hydrocarbons from the formation into the well casing.

In the embodiments of FIGS. 6 and 7, the explosive 130 and 132 preferably is a continuous cord, rope or band, and is distributed evenly throughout the oxygen-rich material 62 so that the detonation of a shaped charge anywhere along the length of the sleeve 30C or 30D will initiate the explosive in both directions. In addition, spacing the explosive 130 and 132 along the length of the sleeve 30C or 30D will ensure spaced apart perforations in the casing and help prevent the explosive force from entirely severing or destroying the casing 12.

As discussed above, the explosive cord or coil could be formed using RDX or pentolite. In the embodiment shown in FIGS. 6 and 7, the explosive 130 and 132 is positioned in a helical shape down through the body of oxygen-rich material 62 and, most preferably, is near the outside of the sleeve 30C or 30D or other container.

In any of the embodiments of the present invention, multiple casing joints 10, 10A, 10B, 10C or 10D, and or multiple well stimulation accessories 28, 28A, 28B, 28C or 28D, or multiple sleeves 30, 30A, 30B, 30C or 30D, or any combination of these, may be used to provide a sequence of stimulation operations. For example, several sleeves may be installed along the length of a single joint of casing, or multiple casing joints, each with its own sleeve, could be installed in a well, and detonated sequentially. In yet another application of this invention, the multiple sleeves could have different amounts of explosives. In this way, the well operator can select from the different levels of stimulation or could stimulate the well on different occasions, depending on the well's production. For example, several sections of casing could be preloaded with different amounts of reactive material (for example, oxygen-rich material and explosive) to be reacted at different times throughout the well's production history.

Methods and devices for introducing oxygen-rich material into the formation in conjunction with the use of shaped charges, and novel shaped charges incorporating internal supplies of oxygen-rich material, are disclosed U.S. Pat. Nos. 7,216,708, issued May 15, 2007, and 7,165,614, issued Jan. 23, 2007, both entitled "Reactive Stimulation of Oil and Gas Wells." The contents of these patents are incorporated herein by reference.

The embodiments shown and described herein are exemplary. Some elements or features of the present invention may be found in the art and, therefore, have not been described in detail herein. The description and drawings are illustrative only, and changes may be made in the combination and arrangement of the various parts and elements described herein without departing from the spirit and scope of the invention as defined in the following claims. The description and drawings do not point out what an infringement of this patent would be, but rather merely provide one example of how to use and make the invention. The limits of the invention and the bounds of the patent protection are measured by the claims. Changes can be made in the combination and arrangement of the various parts and elements described herein without departing from the spirit and scope of the invention as defined in the following claims.

What is claimed is:

1. An accessory for an oil and gas well casing joint, the accessory for use in a well stimulation operation of a formation in an oil or gas well, wherein each casing joint comprises a tubular body with an exterior surface, the accessory comprising:

a sleeve supportable on the exterior surface of the body of the casing joint and sized to be received in an uncased section of the well, wherein the sleeve defines at least one compartment containing oxygen-rich material selected from the group consisting of perchlorates and nitrates, wherein the sleeve forming the compartment is adapted to be pierced by an exploding shaped charge along with the adjacent casing during a stimulation operation, and wherein the sleeve contains no shaped charges directed outwardly towards the formation, and wherein the sleeve is configured to be co-axial with the tubular body of the casing joint.

2. The accessory of claim 1 wherein the at least one compartment consists of a single continuous annular chamber.

3. The accessory of claim 1 further comprising:

at least one shaped charge in the sleeve sized and positioned to perforate the casing and to ignite the oxygen-rich material contained inside the at least one compartment; and a remote controlled detonation assembly in the sleeve operatively connected to the shaped charge.

4. The accessory of claim 3 wherein the shaped charge and the detonation assembly are also contained in the at least one compartment.

5. The accessory of claim 1 wherein the sleeve is adjustably and removably supportable on the body of the casing joint.

6. The accessory of claim 1 further comprising a pair of bumpers supportable on the body of the casing joint above and below the sleeve.

7. The accessory of claim 1 wherein the at least one compartment comprises a plurality of longitudinally spaced annular chambers.

8. The accessory of claim 1 further comprising:

at least one shaped charge in the sleeve sized and positioned to perforate the casing and to ignite the oxygen-rich material contained inside the at least one compartment and wherein all shaped charges in the compartment are positioned to perforate the casing; and a high order explosive in the at least one compartment.

9. The accessory of claim 8 wherein the explosive is a length of primer cord arranged in a helical shape within the oxygen-rich material.

10. The accessory of claim 1 wherein the sleeve contains no shaped charges.

11. A joint of well casing for use in a well stimulation operation of a formation in an oil or gas well, the casing joint comprising:

a tubular body with first and second ends and an exterior surface;

a coupling on the first end;

a coupling on the second end; and at least one sleeve supported on the exterior surface of the body of the casing joint and sized to be received in an uncased section of the well, wherein the at least one sleeve defines at least one compartment containing oxygen-rich material selected from the group consisting of perchlorates and nitrates, wherein the at least one sleeve forming the compartment is adapted to be pierced by an exploding shaped charge along with the adjacent casing during a stimulation operation, and wherein the sleeve contains no shaped charges directed outwardly towards the formation, and wherein the sleeve is co-axial with the tubular body.

12. The well casing joint of claim 11 wherein the at least one compartment consists of a single continuous annular chamber.

13. The well casing joint of claim 11 further comprising:

at least one shaped charge in the sleeve sized and positioned to perforate the casing and to ignite the oxygen-rich material contained inside the at least one compartment; and a remote controlled detonation assembly in the sleeve operatively connected to the shaped charge.

14. The well casing joint of claim 13 wherein the shaped charge and the detonation assembly all also contained in the at least one compartment.

15. The well casing joint of claim 11 wherein the sleeve is adjustably and removably supportable on the body of the casing joint.

16. The well casing joint of claim 11 further comprising a pair of bumpers supportable on the body of the casing joint above and below the sleeve.

17. The well casing joint of claim 11 wherein the at least one compartment comprises a plurality of longitudinally spaced annular chambers.

18. The well casing joint of claim 11 further comprising:

at least one shaped charge in the sleeve sized and positioned to perforate the casing and to ignite the oxygen-rich material contained inside the at least one compartment and wherein all shaped charges in the compartment are positioned to perforate the casing; and a high order explosive in the at least one compartment.

19. The well casing joint of claim 18 wherein the explosive is a length of primer cord arranged in a helical shape within the oxygen-rich material.

20. The well casing joint of claim 11 wherein the sleeve contains no shaped charges.

* * * * *